US009886968B2

(12) United States Patent
Bou-Ghazale et al.

(10) Patent No.: US 9,886,968 B2
(45) Date of Patent: Feb. 6, 2018

(54) ROBUST SPEECH BOUNDARY DETECTION SYSTEM AND METHOD

(71) Applicant: SYNAPTICS INCORPORATED, San Jose, CA (US)

(72) Inventors: Sahar E. Bou-Ghazale, Irvine, CA (US); Trausti Thormundsson, Irvine, CA (US); Willie B. Wu, Chino Hills, CA (US)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 14/197,149

(22) Filed: Mar. 4, 2014

(65) Prior Publication Data

US 2014/0249812 A1 Sep. 4, 2014

Related U.S. Application Data

(60) Provisional application No. 61/772,441, filed on Mar. 4, 2013.

(51) Int. Cl.
*G10L 25/84* (2013.01)
*G10L 25/87* (2013.01)

(52) U.S. Cl.
CPC ..... *G10L 25/84* (2013.01)

(58) Field of Classification Search
CPC ..... G10L 25/84
(Continued)

(56) References Cited

U.S. PATENT DOCUMENTS 6,445,801 B1 * 9/2002 Pastor ..... G10L 21/0208 381/71.1
6,950,796 B2 * 9/2005 Ma ..... G10L 15/20 704/228

(Continued)

*Primary Examiner* — Edwin S Leland, III
(74) *Attorney, Agent, or Firm* — Haynes and Boone, LLP

(57) ABSTRACT

A system for audio processing comprising an initial background statistical model system configured to generate an initial background statistical model using a predetermined sample size of audio data. A parameter computation system configured to generate parametric data for the audio data including cepstral and energy parameters. A background statistics computation system configured to generate preliminary background statistics for determining whether speech has been detected. A first speech detection system configured to determine whether speech was present in the initial sample of audio data. An adaptive background statistical model system configured to provide an adaptive background statistical model for use in continuous processing of audio data for speech detection. A parameter computation system configured to calculate cepstral parameters, energy parameters and other suitable parameters for speech detection. A speech/non-speech classification system configured to classify individual frames as speech frames or non-speech frames, based on the computed parameters and the adaptive background statistical model data. A background statistics update system configured to update the background statistical model based on detected speech and non-speech frames. A second speech detection system configured to perform speech detection processing and to generate a suitable indicator for use in processing audio data that is determined to include speech signals.

19 Claims, 3 Drawing Sheets

(58) Field of Classification Search
USPC ..... 704/233
See application file for complete search history.

(56) References Cited

U.S. PATENT DOCUMENTS

| | | | | |
|---|---|---|---|---|
| 7,277,853 | B1 * | 10/2007 | Bou-Ghazale | G10L 25/87 704/248 |
| 8,175,876 | B2 | 5/2012 | Bou-Ghazale et al. | |
| 2004/0064314 | A1 * | 4/2004 | Aubert | G10L 25/87 704/233 |
| 2004/0215454 | A1 * | 10/2004 | Kobayashi | G10L 15/142 704/231 |
| 2006/0155537 | A1 * | 7/2006 | Park | G10L 25/78 704/243 |
| 2008/0247274 | A1 * | 10/2008 | Seltzer | G01S 3/8083 367/125 |
| 2010/0268533 | A1 * | 10/2010 | Park | G10L 25/78 704/233 |
| 2012/0173234 | A1 * | 7/2012 | Fujimoto | G10L 15/20 704/233 |
| 2014/0249812 | A1 * | 9/2014 | Bou-Ghazale | G10L 25/84 704/233 |
| 2017/0092268 | A1 * | 3/2017 | Kristjansson | G10L 15/20 |

* cited by examiner

ROBUST SPEECH BOUNDARY DETECTION SYSTEM AND METHOD

RELATED APPLICATIONS

The present application claims priority to U.S. Provisional Patent Application No. 61/772,441, filed Mar. 4, 2013, and is related to U.S. Pat. No. 7,277,853, issued Oct. 2, 2007, and also to U.S. Pat. No. 8,175,876, issued May 8, 2012, each of which are hereby incorporated by reference for all purposes.

TECHNICAL FIELD

The present disclosure relates generally to audio processing, and more specifically to robust speech boundary detection that reduces the power requirements for continuous monitoring of audio signals for speech.

BACKGROUND OF THE INVENTION

Processing of audio data for speech signals has typically required a user prompt and subsequent processing of the audio data, based on the known relationship between the point in time at which a speech signal is expected to begin and the time at which the audio data is recorded. Such processes are not directly applicable to continuous processing of audio data for speech signals.

SUMMARY OF THE INVENTION

A system for audio processing comprising an initial background statistical model system configured to generate an initial background statistical model using a predetermined sample size of audio data. A parameter computation system configured to generate parametric data for the audio data including cepstral and energy parameters. A background statistics computation system configured to generate preliminary background statistics for determining whether speech has been detected. A first speech detection system configured to determine whether speech was present in the initial sample of audio data. An adaptive background statistical model system configured to provide an adaptive background statistical model for use in continuous processing of audio data for speech detection. A parameter computation system configured to calculate cepstral parameters, energy parameters and other suitable parameters for speech detection. A speech/non-speech classification system configured to classify individual frames as speech frames or non-speech frames, based on the computed parameters and the adaptive background statistical model data. A background statistics update system configured to update the background statistical model based on detected speech and non-speech frames. A second speech detection system configured to perform speech detection processing and to generate a suitable indicator for use in processing audio data that is determined to include speech signals.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
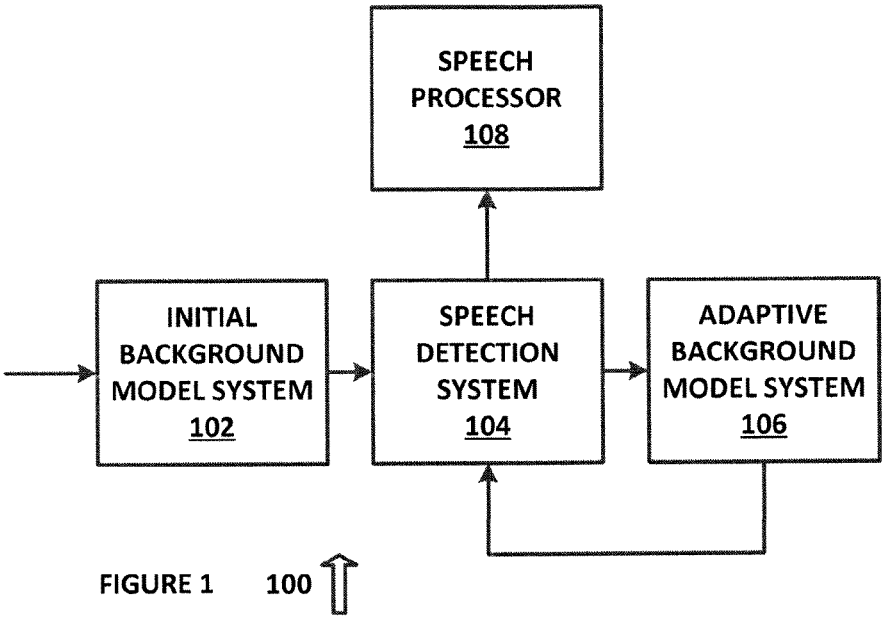
FIG. 1 is a diagram of a system for robust speech boundary detection in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Accurate detection of the beginning and ending of speech, referred to herein as Robust Speech Boundaries Detection (RSBD), is a necessary component in audio systems that are used to detect and process speech signals, and has wide applications in speech recognition, speech coding, voice over Internet protocol (VoIP), security monitoring devices for end user applications or homeland security or other suitable applications which require processing of a large amount of audio data for speech signals. When paired with a speech recognition system, for example, an RSBD system increases the overall recognition performance by limiting the amount of data passed to the speech recognition system, which results in fewer errors in terms of false alarms and hence a higher overall system accuracy. In speech coding, audio conferencing or VoIP applications, accurately detecting speech boundaries also reduces the amount of data transmitted, as non-speech sounds do not require accurate parameterization, nor the transmission bandwidth required for speech. For audio security monitoring, accurate speech boundary detection cuts down the amount of time that a human operator must spend listening to the recorded data and the effort required for further analysis. Offering an RSBD system as part of an audio pre-processing suite of algorithms can thus improve overall system performance and reduces power consumption.

Accurate speech detection can be utilized for many applications, such as for television voice wake up applications, which may require the speech recognition (SR) system to run continuously, which can require very high power consumption and can lead to poor recognition performance, as the entire audio data stream is being passed to the data processing system, which creates more opportunity for error. Applying an energy detection threshold prior to the speech recognition system causes the SR system to operate too frequently, and also results in higher power consumption and poorer speech recognition performance. The RSBD system of the present disclosure can be used to detect the beginning and ending of speech activity in a continuous monitoring mode, such as by using an algorithm that runs and processes input frames of audio data continuously and that determines the boundaries of speech activity. As such, the present disclosure provides a system that is sensitive to speech activity, and which can detect all speech input (because missing the beginning of speech data reduces voice recognition performance), yet which is robust, so that it does not trigger on typical daily noises and short bursts of high energy sounds such as audio clicks, claps, or stationary high level background noise.

Earlier speech detection systems include U.S. Pat. No. 7,277,853, and U.S. Pat. No. 8,175,876, which are hereby incorporated by reference for all purposes as if set forth specifically herein. Those references disclose an endpoint detection algorithm that characterizes the background audio data based on the initial 140 msec of data, and which then utilizes energy and cepstral distance to classify individual frames of data as speech or non-speech based on the initial background noise model. A second algorithmic layer uses this frame-by-frame speech/non-speech classification to determine the beginning and ending of speech activity by using confidence measures. As such, the prior art is not applicable to continuous speech recognition in common noise environments.

The present disclosure addresses the challenges faced by endpoint detection algorithms when used in realistic common noise environments. To enhance the end user experience, the present disclosure provides RSBD systems and methods which can detect speech activity even during the initialization process, which eliminates the need for the user to repeat their voice prompt. Moreover, the present disclosure provides RSBD systems and methods that generate a reliable background noise model by detecting speech activity during initialization and eliminating those frames from the background statistical model. The present disclosure provides RSBD systems and methods that can differentiate between high energy non-speech noises and high energy speech to reduce false triggers, and to distinguish between low energy speech sounds and low energy noise to reduce falsely rejecting speech. The present disclosure tracks background noise changes and adapts to the noises without the need for a full noise suppression solution. Adapting to the environment reduces false triggering when the noise level increases.

The RSBD system and method of the present disclosure can run continuously and for very long periods of time, such as days or weeks, and can build a set of historical data for a given location and application. Hence, as the RSBD system and method of the present disclosure detects speech boundaries and is subsequently re-initialized to determine subsequent speech boundaries, it can use the accumulated data and statistics to determine the speech boundaries in the upcoming audio stream.

The system and method of the present disclosure can be implemented in different embodiments, which can utilize one or more of the following systems and algorithms:

(1) a "smart background statistics computation" module for computing the initial background statistical model rather than a blind module which assumes that the initial 140 msec of data consists of silence. This module can classify frames of audio data into reliable and unreliable frames, so as to utilize reliable frames in computing the background statistics model.

(2) a module for detecting if beginning of speech occurred during the initialization (in contrast to assuming that an initial time period, such as 140 msec, contains no speech). This module can detect the beginning of speech and can continue to computing a background statistics model instead of exiting and asking the user to repeat the prompt. This module can also detect speech frames and exclude them from background noise model computations to achieve a more accurate model.

(3) a "smart background statistics update (SBSU)" module which can selectively update the background noise statistics based on a set of confidence measures and determines when to keep the model constant.

(4) a re-initialization module which can utilize learned background statistics when an endpoint algorithm is re-initialized, instead of resorting to preset thresholds.

The RSBD system and method of the present disclosure can provide better performance in speech boundary detection in a changing background noise environment as compared to the prior art. The RSBD system and method of the present disclosure can reject audio clicks, keyboard strokes, opening and closing of cabinets, faint background music, a food blender and other common residential or business office sounds, whereas the prior art would trigger on these same noises, and can detect the speech boundaries even when the audio signal is embedded in high background noise.

The RSBD system and method of the present disclosure can also distinguish between speech/non-speech sounds without requiring a full speech recognition system, which consumes significantly more power and memory. It is capable of tracking the background noise and adapting the background statistics module without requiring a full noise reduction system which consumes more power as well. It can also detect speech onset even during initialization without introducing prohibitive delays, nor requiring a powerful data crunching engine, and then proceeds to calculating the background noise model, in contrast to the prior art, which prompts the user if the user speaks too soon and exits the application without determining the speech boundaries. The prior art does not adapt to the background, and at re-initialization, the prior art starts analysis from preset thresholds as opposed to building on the prior history and acquired statistical data.

In one exemplary embodiment the present disclosure can be implemented as an algorithm, referred to as endpoint detection or RSBD algorithm, for detecting the beginning and ending of speech activity in a continuous monitoring mode. Continuous monitoring implies that the algorithm runs and processes input frames continuously and determines the boundaries of speech activity, such that it does not trigger on short bursts of high energy sounds such as audio clicks, claps, or stationary high level background noise, yet is sensitive enough to not miss any speech input. When the beginning of speech is detected, the algorithm can send a flag and a message indicating that the beginning of speech has been found "x" frames ago. The algorithm then proceeds to find the ending of speech and similarly sends a flag and a message indicating that ending of speech has been detected. Once the speech boundaries are detected, the endpoint algorithm can re-initialize itself and start looking for speech activity once again. Alternatively, it can wait to be re-initialized by the system, or other suitable embodiments can also or alternatively be utilized.

The algorithm of the present disclosure can utilize energy and cepstral distance to classify individual frames of data as speech or non-speech, builds a robust model for background statistics, and adapts to the background environment. A second algorithmic layer can use this frame-based speech/non-speech classification to determine the beginning and ending of speech activity by using confidence measures. The algorithm can be implemented in two phases. In the first phase, the algorithm can use an initial few frames (such as 140 msec worth of frames) to compute the statistics of the background environment. This first phase can further consist of three components: (1) parameter computation, (2) background statistics computation and (3) detection of speech during the initial frames. After the first phase, the algorithm proceeds to the second phase, in which the beginning and ending of speech activity is determined. The second phase can consist of four major components: (1) parameter computation, (2) speech/non-speech classification based on a single frame, (3) updating the background statistics in order to adapt to changing background environments, and (4) determining the beginning and ending of speech based on accumulated past history.

The system and algorithm of the present disclosure can adapt to varying background noise and can run continuously, by generating a more robust model for background statistics by selecting which frames are valid to include when computing the background statistics and which frames to discard from this computation during the initial frames (to avoid building an incorrect background statistics model). Speech detected during the initial frames (if speech is present) is then processed to determine the end of speech. False triggers on internal audio clicks, hand clapping or other short bursts of high energy especially during the initial frames is avoided, and the background characteristics are determined and adapted to the new environment. The background statistics are selectively updated based on a set of confidence measures that are used to determine when to keep the background statistics model constant. This is a component of the SBSU as well. The learned background characteristics are then utilized when the endpoint algorithm is re-initialized.

The major components of the RSBD algorithm are listed below:

(A) Initialize the endpoint module at boot-up/start-up;

(B) Compute cepstral parameters and energy for every frame;

(C) Compute initial background silence statistics;

(D) Determine if beginning of speech occurred during the initial background statistics computation;

(E) Perform speech/non-speech classification for every frame;

(F) Update background statistics to adapt to varying background characteristics;

(G) Determine if start of speech was found based on confidence measure;

(H) Determine if end of speech was found based on a confidence measure; and (I) Perform re-initialization of the endpoint module to locate subsequent speech endpoints.

Initialization of the endpoint module at boot-up/start-up is performed only at first-time initial boot-up. The algorithm assigns pre-determined thresholds, floor and ceiling values for energy, cepstral mean and cepstral distance. Upon subsequent re-initialization, the algorithm builds on the learned background energy and cepstral mean values.

Computation of the cepstral parameters and frame energy by using a 10th order Ipc and an 8th order cepstral to compute the cepstral vector. This is the same parameter set as the original end-pointer algorithm. In one exemplary embodiment, the signal can be expected to be sampled at 8 KHz, a Hamming window with a duration of 240 samples (30 msec) with 33% overlap (20 msec frame rate) can be applied, pre-emphasis can be used to boost high frequency components, the first 10 auto-correlation coefficients can be computed, Levinson-Durbin recursion can be performed to obtain 10 LPC-coefficients, the LPC coefficients can be converted to cepstral coefficients, frequency warping can be performed to spread low frequencies, and the zeroth cepstral coefficient can be separated from the higher coefficients since it is dependent on gain while the remaining coefficients capture information about the signal's spectral shape.

Computation of the initial background silence statistics can be performed as follows. First, if high energy frames are detected then high energy values are replaced with previously computed reference energy values. Next, the spectrum characteristics of high energy frames are replaced with the previously computed reference spectral characteristics. Next, the cepstral mean vector is computed, then the average energy is computed. A minimum energy floor is then imposed, and the energy thresholds are computed. The cepstral distance is then computed and a cepstral distance constraint is imposed.

Determination of whether the beginning of speech occurred in initial frames during background statistics computation can be performed in two modes of operation, depending on whether it is called during system boot-up or during subsequent re-initialization of the RSBD system. For the very first time initialization or during system boot-up, the algorithm can make a decision based on a set of parameters gathered by the previous initial background silence statistics module to determine if speech is present. However, upon subsequent re-initializations, the algorithm performs additional processing as described below to determine the beginning of speech.

In the case of system boot-up, the number of frames with high energy values and the total number of frames used for computing the background statistics and the energy values of the high energy frames are tracked to determine whether the beginning of speech was detected in the initial frames. If it is determined that speech was detected, then a flag or other suitable indicator is set to mark that the beginning of speech has been declared, and the algorithm proceeds to finding the ending of speech. If speech is not found during the initial few frames then the algorithm proceeds to additional steps as needed to find the beginning of speech.

Frame-by-frame speech/non-speech classification is performed to classify whether a single frame possesses speech or non-speech characteristics, and can be implemented using the same module as the original end-pointer algorithm.

Updating of background silence statistics to adapt to varying background characteristics is then performed, and a confidence test is performed to determine whether a background silence region has been detected before updating background statistics. The validity of the frame's cepstral distance is then established before using it to update the background statistics (and hence avoid misleading the background model). The cepstral distance is then updated.

The validity of the frame's energy is then established before using it to update the background statistics, and the background energy is then updated and the energy thresholds are recomputed as described above. It is then determined whether the start of speech has been found based on the accumulated history, which can be performed using the same module as the original end-pointer algorithm. It is then determined whether the end of speech has been found based on accumulated history, and this module can also be the same as the original end-pointer algorithm. The endpoint module is then initiated. Instead of using preset threshold values for energy and cepstral mean as was done during initialization at boot-up, the re-initialization process builds on the learned background energy and cepstral mean.

The previously computed background energy is then saved and used to initialize the subsequent EP call. This new value can serve as a reference for background energy instead of using preset thresholds. The previously computed cepstral mean is then saved for use in subsequent calls, and other EP parameters are reset.

In one exemplary embodiment, the following parameters can be used for fine tuning:

The number of initial silence frames to compute silence statistics: 7

The number of frames of consecutive speech frames required to declare beginning of speech: 8

The number of non-speech frames required to declare end of speech: 20

The number of frames to backup for final endpoint (to remove silence from ending): 0

The number of frames to extend the beginning of speech (to add extra silence frames to beginning): 0

The initial threshold for silence energy (10 log 10): 90.0

The minimum energy for silence/speech threshold (10 log 10): 52.0

The minimum cepstral distance between a speech and silence frame (used at initialization): 5.0

The absolute minimum floor for cepstral distance: 1.5

The number of consecutive silence frames required before updating silence statistics: 10

The minimum value of a frame's cepstral distance in silence regions in order to use it to update the background statistics. This value ranges between 0.0 and 1.5. When set to 0.0, then cepstral statistics are updated every frame. Setting it to 0.0 results in finer endpoints. For non-zero values, the cepstral statistics are only updated if the frame's cepstral distance is greater than this value. This parameter decides how crude or how refined the endpoints are.

A relative threshold (implies 60% above) can be used for initial parameter estimation during the first few frames, such as to calculating if a frame has very high energy, therefore detecting speaking too soon.

Reference frame energy can be used for initial parameter estimation. In one exemplary embodiment, if a frame is 10% above reference energy, then it can be dropped from background silence energy estimation.

A background cepstral distance value between 1.5 and 5 can be used, and a cepstral distance threshold can be set at 20% above that value to allow for a continuous threshold value (between 1.5 and 5) instead of a fixed value of 5

FIG. 1 is a diagram of a system 100 for robust speech boundary detection in accordance with an exemplary embodiment of the present disclosure. System 100 can be implemented in hardware or a suitable combination of hardware and software, and can be one or more software systems operating on a general purpose processor.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as keyboards or mouses, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

System 100 includes initial background model system 102, speech detection system 104 and adaptive background model system 106, which operate continuously to provide speech boundary detection as discussed herein. Initial background model system 102 performs an initial audio data processing using audio data for a predetermined period of time, such as 140 msecs. Speech detection system 104 is then used to determine whether speech has been detected. Adaptive background model system 106 then performs adaptive background model updating to allow speech detection to be continuously performed. The updated background model is then used by speech detection system 106 to determine whether speech has been detected. If speech is detected, a speech detection signal is provided to speech processor 108, which can be a speech coding system, a VoIP system, a speech recognition system, a security monitoring device or other suitable systems. Processing of the adaptive background model and subsequent audio signals then continues.

Figure 2:
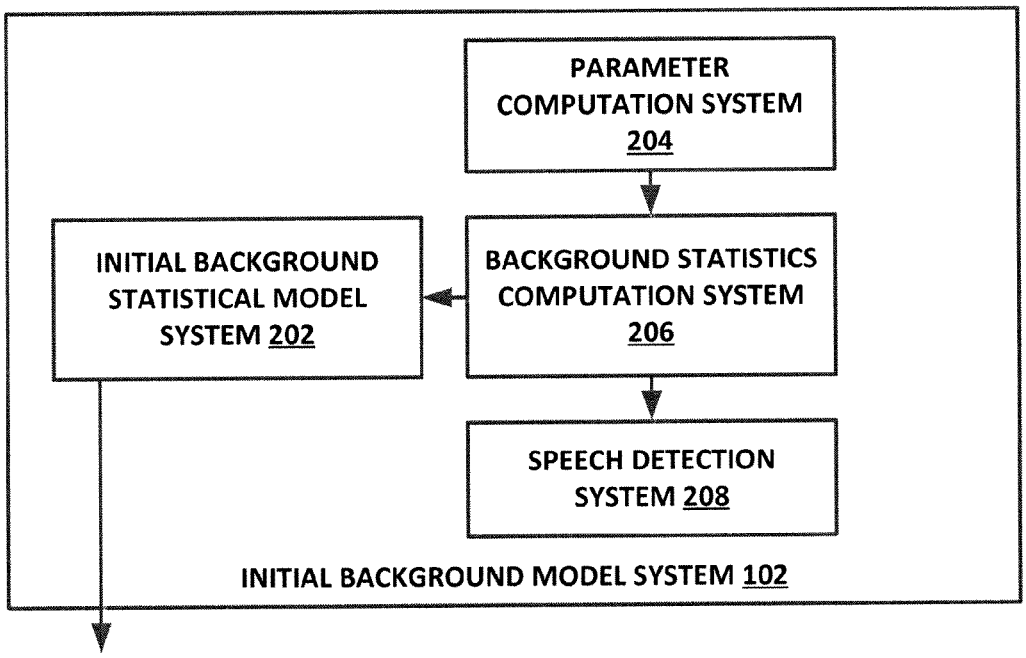
FIG. 2 is a diagram of a system for initial background modeling in accordance with an exemplary embodiment of the present disclosure.

FIG. 2 is a diagram of a system 200 for initial background modeling in accordance with an exemplary embodiment of the present disclosure. System 200 includes initial background statistical model system 202, parameter computation system 204, background statistics computation system 206 and speech detection system 208, as previously described herein, each of which can be implemented in hardware or a suitable combination of hardware and software.

Initial background statistical model system 202 generates an initial background statistical model, such as using a predetermined sample size of audio data. Parameter computation system 204 generates parametric data for the audio data, such as cepstral and energy parameters or other suitable parameters. Background statistics computation system 206 generates preliminary background statistics for determining whether speech has been detected, and speech detection system 208 determines whether speech was present in the initial sample of audio data.

Figure 3:
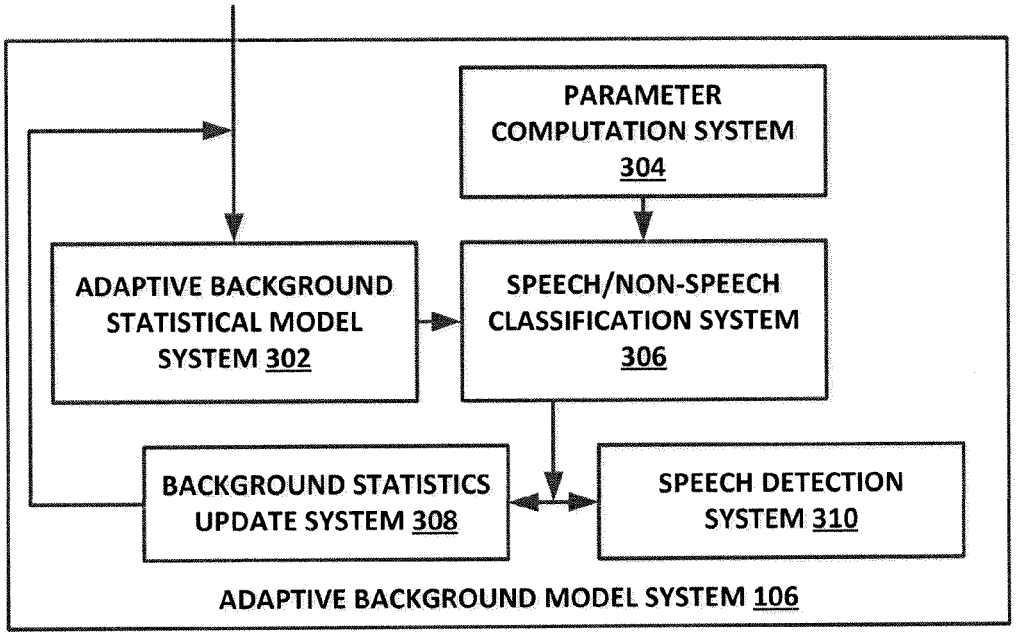
FIG. 3 is a diagram of a system for adaptive background modeling in accordance with an exemplary embodiment of the present disclosure.

FIG. 3 is a diagram of a system 300 for adaptive background modeling in accordance with an exemplary embodiment of the present disclosure. System 300 includes adaptive background statistical model system 302, parameter computation system 304, speech/non-speech classification system 306, background statistics update system 308 and speech detection system 310, as previously described herein, each of which can be implemented in hardware or a suitable combination of hardware and software.

Adaptive background statistical model system 302 provides an adaptive background statistical model for use in continuous processing of audio data for speech detection.

Parameter computation system 304 calculates cepstral parameters, energy parameters and other suitable parameters for speech detection. Speech/non-speech classification system 306 classifies individual frames as speech frames or non-speech frames, based on the computed parameters and the adaptive background statistical model data. Background statistics update system 308 updates the background statistical model based on detected speech and non-speech frames. Speech detection system 310 performs speech detection processing and generates a suitable indicator for use in processing audio data that is determined to include speech signals.

Figure 4:
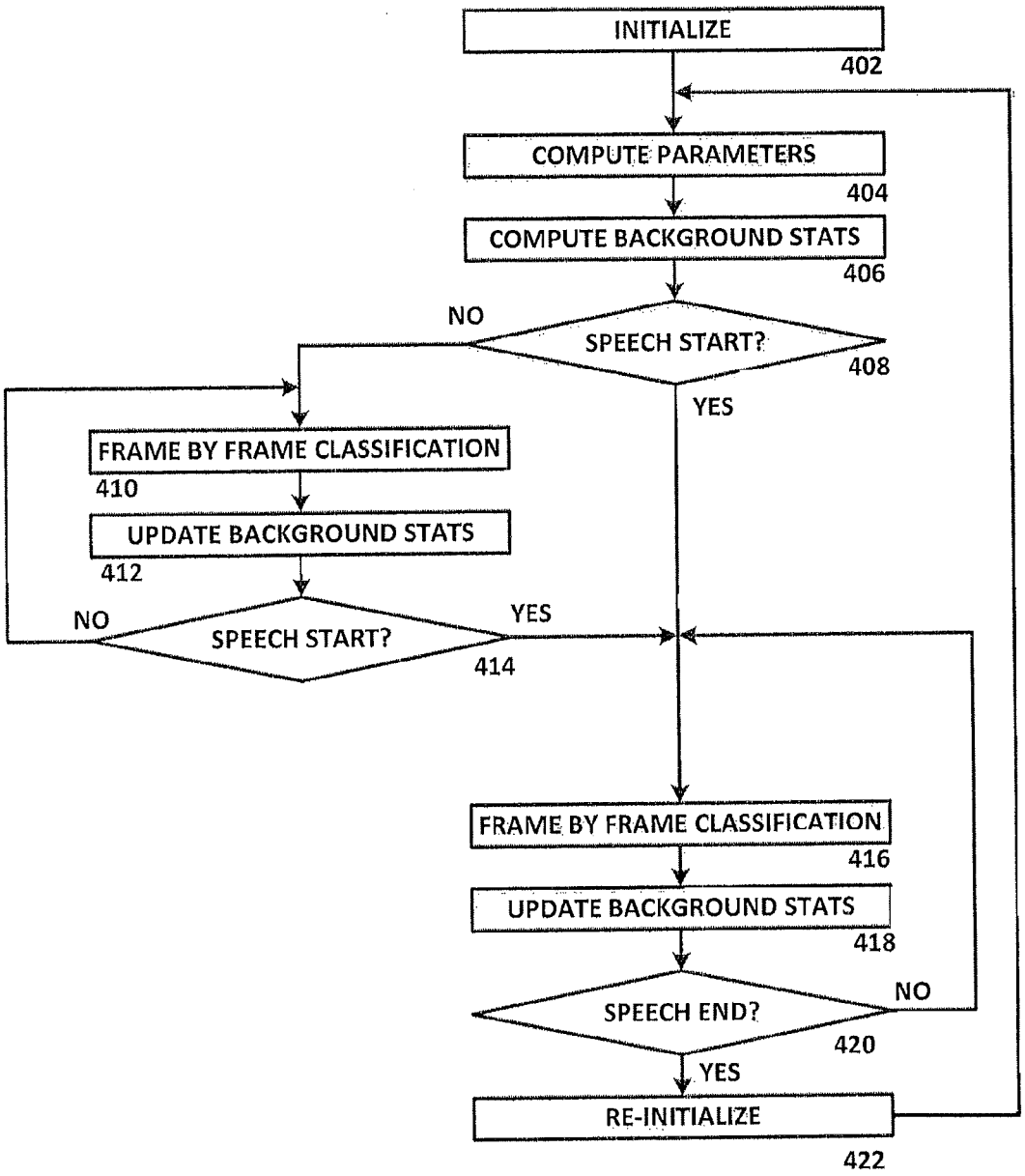
FIG. 4 is a diagram of an algorithm for robust speech boundary detection in accordance with an exemplary embodiment of the present disclosure.

FIG. 4 is a diagram of an algorithm 400 for robust speech boundary detection in accordance with an exemplary embodiment of the present disclosure. Algorithm 400 can be implemented in hardware or a suitable combination of hardware and software, and can be one or more software systems operating on a processor or processors.

Algorithm 400 begins at 402, where variables are initialized, as described herein. The algorithm then proceeds to 404, where parameters for a preliminary sample of audio data are determined, such as cepstral parameters, energy parameters and other suitable parameters. The algorithm then proceeds to 406 where preliminary background statistics are calculated. The algorithm then proceeds to 408 where it is determined whether speech has started. If it is determined that speech has not started, the algorithm proceeds to 410, otherwise the algorithm proceeds to 416.

At 410, frame by frame classification is performed. The algorithm then proceeds to 412, where background statistics are updated, and the algorithm then proceeds to 414 where it is determined whether the start of speech has been detected. If the start of speech has not been detected, the algorithm returns to 410, otherwise the algorithm proceeds to 416.

At 416, frame by frame classification of the audio data is performed to determine whether each frame is a speech frame or a non-speech frame, and the algorithm proceeds to 418, where background statistics are updated using the non-speech frame data. The algorithm then proceeds to 420 where it is determined whether an end of speech has been detected. If an end of speech has not been detected, the algorithm returns to 416, otherwise the algorithm proceeds to 422 where audio processing is reinitialized and the algorithm returns to 404. In one exemplary embodiment, additional details regarding the processes of algorithm 400 can be based on the exemplary processes described further herein.

In operation, algorithm 400 allows speech boundary detection to be performed, such as for applications in which audio data is continually received and processed to detect spoken commands. Although algorithm 400 has been shown in flowchart format, object-oriented programming conventions, state diagrams, a Unified Modelling Language state diagram or other suitable programming conventions can also or alternatively be used to implement the functionality of algorithm 400.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A speech boundary detection system comprising:

an input configured to receive an audio signal comprising a continuous stream of audio frames;

an initial audio sample processing system configured to receive an initial audio sample comprising a predetermined number of audio frames received during system initialization, and generate an initial background noise model using non-speech frames of the initial audio sample, the initial audio sample processing system comprising:

an initial parameter computation system configured to compute initial audio signal characteristics for each frame of the initial audio sample;

an initial background noise computation system configured to classify each frame of the initial audio sample as either speech or non-speech and generate the initial background noise model from the non-speech frames of the initial audio sample; and an initial speech detection system configured to determine whether a beginning of speech is present in the initial audio sample using the computed initial audio signal characteristics and the initial background noise model.

2. The system of claim 1 further comprising:

a speech endpoint detection system configured to detect a speech endpoint based on a frame by frame classification of audio signal frames as speech or non-speech; and an adaptive background noise modeling system configured to receive the initial background noise model and generate an adaptive background noise model during speech detection for use by the speech endpoint detection system.

3. The system of claim 1 wherein the initial parameter computation system is configured to calculate a cepstral distance for each frame of the initial audio sample.

4. The system of claim 2 wherein the speech endpoint detection system further comprises a speech/nonspeech classification system configured to classify individual frames of the audio signal as speech frames or non-speech frames, based on computed audio signal characteristics and the adaptive background noise model.

5. The system of claim 2 wherein the adaptive background noise modeling system is further configured to update the adaptive background noise model based on detected speech and non-speech frames.

6. The system of claim 2 wherein the initial speech detection system is configured to generate an indicator for use in processing portions of the initial audio sample of the audio signal that are determined to include a beginning of speech.

7. The system of claim 6 further comprising a speech processor configured to operate on the portions of the audio signal that are determined to include the speech signal, the speech processor configured to receive the indicator from the speech detection system.

8. The system of claim 2, wherein the initial background noise model is initialized to the adaptive background noise model generated during a previous speech boundary iteration.

9. The system of claim 8, wherein the initial background noise model is re-initialized after the speech endpoint detection system identifies a speech endpoint in the audio signal.

10. The system of claim 1 wherein the initial audio sample comprises audio frames from the first 140 msec of the audio signal received at initialization.

11. The system of claim 1 wherein the initial background noise computation system is further configured to replace each detected speech frame with a reference frame and generate the initial background noise model from the non-speech frames and reference frames.

12. The system of claim 1 wherein the initial sample comprises the first predetermined number of audio frames received by the speech boundary detection system after system start-up.

13. A method for processing an input audio signal in a speech boundary detection system comprising:

starting an initialization process for the speech boundary detection system;

receiving an initial sample of the audio signal, the initial sample comprising a predetermined number of audio frames received during initialization;

computing audio signal characteristics for each frame of the initial sample of the audio signal;

generating the initial background noise model from the initial sample of the input audio signal by classifying each frame of the initial sample as either speech or non-speech, replacing speech frames with reference frames, and computing initial background statistics using the non-speech frames and reference frames; and determining whether a beginning of speech is present in the initial sample of the audio signal using the computed audio signal characteristics and the initial background noise model.

14. The method of claim 13, further comprising:

if a beginning of speech has not been detected in the initial sample, performing a frame by frame classification of the input audio signal as speech or noise, generating an updated background noise model and detecting whether the beginning of speech has been detected in classified frames.

15. The method of claim 14 further comprising, if a beginning of speech has been determined in the initial sample of the input audio signal, performing a frame by frame classification of the input audio signal as speech or noise, updating the background noise model and detecting the end of speech in classified frames.

16. The method of claim 15 further comprising re-initializing the initial background noise model with the updated background noise model if the end of speech has been detected.

17. The method of claim 15 further comprising excluding detected speech frames from the updated background noise model.

18. The method of claim 15 further comprising selectively updating the updated background noise model based on a set of confidence measures.

19. The method of claim 15 wherein the parameter value comprises one of a cepstral parameter and an energy parameter.

* * * * *